US006968794B1

(12) United States Patent
Price et al.

(10) Patent No.: US 6,968,794 B1
(45) Date of Patent: Nov. 29, 2005

(54) PRESSER FOOT CONTROL SYSTEM

(75) Inventors: Elvin C. Price, Decula, GA (US); Preston B. Dasher, Lawrenceville, GA (US); Warren G. Oxley, Auburn, GA (US)

(73) Assignee: Atlanta Attachment Company, Lawrenceville, GA (US)

( * ) Notice: Subject to any disclaimer, the term of this patent is extended or adjusted under 35 U.S.C. 154(b) by 13 days.

(21) Appl. No.: 10/817,020

(22) Filed: Apr. 2, 2004

Related U.S. Application Data

(60) Provisional application No. 60/460,454, filed on Apr. 3, 2003.

(51) Int. Cl.[7] ..... D05B 29/00
(52) U.S. Cl. ..... 112/475.01; 112/238
(58) Field of Search ..... 112/235, 237, 238, 112/239, 311, 313, 475.01, 475.07, 475.08

(56) References Cited

U.S. PATENT DOCUMENTS

| | | | | |
|---|---|---|---|---|
| 1,947,058 A | | 2/1934 | Pittoni | 112/3 |
| 3,013,513 A | | 12/1961 | Judelson | 112/203 |
| 3,055,326 A | * | 9/1962 | Greulich | 112/235 |
| 3,490,061 A | | 1/1970 | Docker | 112/2.1 |
| 3,641,954 A | | 2/1972 | Kalning et al. | 112/3 |
| 3,673,906 A | | 7/1972 | Cash | 83/208 |
| 4,013,026 A | | 3/1977 | Hall | 112/153 |
| 4,019,447 A | | 4/1977 | Blessing et al. | 112/121.11 |
| 4,043,282 A | | 8/1977 | Fanghanel | 112/3 |
| 4,058,071 A | * | 11/1977 | Dunn et al. | 112/235 |
| 4,067,269 A | | 1/1978 | Fanghanel | 112/3 |
| 4,117,790 A | | 10/1978 | Hasegawa et al. | 112/309 |
| 4,141,304 A | | 2/1979 | Masuda | 112/153 |
| 4,181,085 A | | 1/1980 | Conner, Jr. | 112/121.12 |
| 4,290,376 A | | 9/1981 | Brusasca | 112/121.26 |
| 4,381,722 A | * | 5/1983 | Takeuchi et al. | 112/235 |
| 4,449,464 A | | 5/1984 | Porter | 112/311 |
| 4,462,129 A | | 7/1984 | Brannock | 5/474 |
| 4,498,404 A | | 2/1985 | Sadeh | 112/121.12 |
| 4,691,651 A | | 9/1987 | Junemann | 112/259 |
| 4,703,706 A | | 11/1987 | Plante | 112/265.1 |
| 4,726,309 A | * | 2/1988 | Popp | 112/313 |
| 4,742,789 A | | 5/1988 | Pestel et al. | 112/262.3 |
| 4,776,579 A | | 10/1988 | Romand et al. | 271/228 |
| 4,794,873 A | | 1/1989 | Dordi et al. | 112/2.1 |
| 4,813,364 A | | 3/1989 | Boser | 112/304 |
| 4,821,656 A | | 4/1989 | Dordi et al. | 112/2.1 |
| 4,825,787 A | | 5/1989 | Babson et al. | 112/262.3 |
| 4,827,856 A | | 5/1989 | Rohr | 112/63 |
| 4,838,186 A | | 6/1989 | Resta et al. | 112/2.1 |

(Continued)

FOREIGN PATENT DOCUMENTS

| | | | |
|---|---|---|---|
| DE | 31 39426 A1 | 4/1983 | D05B 21/00 |

(Continued)

OTHER PUBLICATIONS

Yamaichi, Tape Binding and Sewing Robot System, Y&Y-RB-A System.

*Primary Examiner*—Ismael Izaguirre
(74) *Attorney, Agent, or Firm*—Womble Carlyle Sandridge & Rice, PLLC

(57) ABSTRACT

A presser foot control system for a sewing station for sewing heavy gauge or thick materials includes an actuator for selectively applying and relieving an additional compression force to the presser foot of the sewing station for compressing and feeding the material being sewn to enable engagement and pickup of the threads carried by the needle by a looper of the sewing station.

14 Claims, 4 Drawing Sheets

U.S. PATENT DOCUMENTS

| | | | | |
|---|---|---|---|---|
| 4,905,615 | A | 3/1990 | Pofferi | 112/2.1 |
| 4,958,579 | A | 9/1990 | De Weers | 112/2.1 |
| 4,998,965 | A | 3/1991 | Easom | 112/305 |
| 5,018,462 | A | 5/1991 | Brocklehurst | 112/121.12 |
| 5,138,962 | A * | 8/1992 | Klundt | 112/311 |
| 5,145,144 | A | 9/1992 | Resta et al. | 248/637 |
| 5,185,897 | A | 2/1993 | Van Laanen | 5/455 |
| 5,282,433 | A | 2/1994 | Freermann et al. | 112/153 |
| 5,289,788 | A | 3/1994 | Fukumoto | 112/121.12 |
| 5,309,854 | A | 5/1994 | Mulcahey et al. | 112/314 |
| 5,341,755 | A | 8/1994 | Kawasaki | 112/263 |
| 5,367,968 | A | 11/1994 | Diaz | 112/262.3 |
| 5,483,909 | A | 1/1996 | Nogueras | 112/475.04 |
| 5,515,796 | A | 5/1996 | Ogle et al. | 112/2.1 |
| 5,526,761 | A | 6/1996 | Mulcahey et al. | 112/475.01 |
| 5,529,004 | A | 6/1996 | Porter et al. | 112/470.03 |
| 5,537,699 | A | 7/1996 | Bonaddio et al. | 54/474 |
| 5,560,308 | A | 10/1996 | Eto | 112/470.07 |
| 5,586,511 | A | 12/1996 | Porter et al. | 112/2.1 |
| 5,617,802 | A | 4/1997 | Cash | 112/117 |
| 5,647,293 | A | 7/1997 | Price et al. | 112/470.17 |
| 5,678,502 | A | 10/1997 | Mulcahey et al. | 112/475.08 |
| 5,809,919 | A | 9/1998 | Mitchell et al. | 112/470.07 |
| 5,881,656 | A | 3/1999 | Grant | 112/2.11 |
| 5,915,319 | A | 6/1999 | Price et al. | 112/470.16 |
| 5,943,971 | A | 8/1999 | Trickett et al. | 112/2.1 |
| 6,000,352 | A | 12/1999 | Porter et al. | 112/470.12 |
| 6,202,579 | B1 | 3/2001 | Olewicz et al. | 112/2.1 |
| 6,209,468 | B1 | 4/2001 | Marcangelo et al. | 112/475.06 |
| 6,397,768 | B1 | 6/2002 | Dasher et al. | 112/2.11 |
| 6,520,101 | B2 * | 2/2003 | Sano et al. | 112/237 |
| 6,648,585 | B2 | 11/2003 | Block et al. | 414/759 |
| 6,736,077 | B2 * | 5/2004 | Pokrishevsky et al. | 112/475.01 |
| 2002/0050117 | A1 | 5/2002 | Dasher et al. | 53/117 |

FOREIGN PATENT DOCUMENTS

| | | | | |
|---|---|---|---|---|
| DE | 37 12493 | A1 | 5/1987 | D05B 21/00 |
| EP | 0264 618 | A1 | 4/1988 | D05B 11/00 |
| EP | 0 330 285 | B1 | 2/1989 | D05B 11/00 |
| EP | 0 200 368 | B1 | 10/1990 | D05B 25/00 |
| EP | 0682135 | | 11/1995 | D05B 11/00 |
| FR | 1567893 | | 9/1967 | D05B 35/00 |
| GB | 1384073 | | 2/1975 | D05B 27/00 |
| JP | 7308465 | | 11/1995 | D05B 11/00 |
| WO | WO 92/12282 | | 7/1992 | D05B 11/00 |
| WO | WO 95/25194 | | 9/1995 | D05B 21/00 |

* cited by examiner

PRESSER FOOT CONTROL SYSTEM

CROSS REFERENCE TO RELATED APPLICATIONS

The present application claims priority to U.S. Provisional Application Ser. No. 60/460,454, filed Apr. 3, 2003.

FIELD OF THE INVENTION

The present invention generally relates to systems for sewing textile materials or work pieces, and in particular, to a control system for controlling the engagement of the presser foot of a sewing station when sewing thicker, heavier gauge materials.

BACKGROUND OF THE INVENTION

Top feed systems that include a top feed dog and/or a feed belt for feeding work pieces through a sewing station are known. In such systems, the fabric material will be engaged between the top feed dog and a bottom feed dog, so as to pull the fabric material therebetween for feeding the fabric material through the sewing station. Such top feed systems generally are used for feeding heavier gauged fabric materials by compressing the fabric material against the bottom feed dogs and pulling the material forward in a walking motion as the material is sewn. However, with especially thick, heavy gauge fabric materials such as foamed pads and/or border materials for mattresses, the thickness of such textile materials can create a problem during sewing when the presser foot of the sewing station must apply added pressure to compress the fabric material to an amount sufficient to enable the needle to penetrate far enough so that the stroke of the loopers engages the threads of the sewing needle. Without such compression, the needle will not penetrate fully through the fabric and thus the threads being sewn by the needle accordingly will not be engaged by the loopers, resulting in an improperly sewn work piece that must be discarded or resewn. The problem with applying such added pressure to the presser foot is, however, that the resulting tighter engagement of the presser foot with the material work piece tends to create friction or drag that can hinder the movement of the material and resist the clamping engagement between the top and bottom feed dogs. As a result, as the top feed dog engages and bears against the fabric, instead of moving the fabric under the presser foot, the top feed dog can tend to pick or tear the fabric material as it moves thereover, resulting in an unacceptable work piece.

In an effort to address this problem, prior art devices have included systems that apply pressure to the presser foot, such as through springs or cylinders, during the penetration of the needle and engagement of the loopers therewith. Thereafter, as the needle stroke or cycle is completed and the needle is raised, a mechanical linkage tied to the feed dogs causes the presser foot to be raised as the top feed dog is lowered into engagement with the material in its stepping or walking motion. As the feed dogs complete the pulling cycle and the top feed dog begins to be raised, the mechanical linkage thereafter allows the presser foot to be lowered back down into compressive engagement with the upper surface of the fabric. A problem that exists with such a rigid, structured mechanical linkage is that it tends to significantly limit the speed of operation of the sewing machine, thus limiting the production rates of such sewing systems. In addition, these mechanical linkages are hard to lubricate because they cannot be sealed and thus typically are subject to significant friction and vibration. Further, the lubrication of such systems must be limited to avoid soiling or contaminating the fabrics being sewn with excess oil or other applied lubricants.

Accordingly, it can be seen that a need exists for a system that controls the application of pressure to a presser foot during the sewing of thicker or heavier gauge fabrics that enables greater production rates and speeds and addresses the foregoing related and unrelated problems in the art.

SUMMARY OF THE INVENTION

Briefly described, the present invention generally relates to a presser foot control system for controlling the application of additional pressure or compressive force to the presser foot of a sewing station to compress thicker or heavier gauge fabric materials being sewn. The additional pressure ensures that the needles of the sewing station will penetrate the fabric material a sufficient amount to enable the loopers of the sewing station to engage and pickup the needle threads during a sewing or flanging operation.

The presser foot control system generally includes a pressure control assembly mounted adjacent a sewing area of the sewing station. The pressure control assembly generally includes an actuator such as a hydraulic or pneumatic cylinder, motor, spring set, or mechanically timed drive mechanism that will be actuated and de-actuated by a control system of the sewing station in timed relation to the reciprocation of sewing needles of the sewing station so as to periodically compress and release the fabric material being sewn. The actuator generally will be connected to a presser foot lift lever having a first or proximal end to which the presser foot is mounted, a second or distal end, and a pivot point intermediate the first and second ends. A compression spring or similar biasing member further can be mounted between the actuator and presser foot lift lever for applying a nominal compression force to the presser foot for maintaining contact and slight compression of the fabric material being sewn during transfer or movement of the fabric material through the sewing area.

The presser foot lift lever further is generally connected to a drive mechanism that typically includes an eccentric connected to the main drive shaft of the sewing station, which communicates the reciprocal motion of the needles to the presser foot lift lever of the presser foot control system. Thus, as the needles are reciprocated downwardly into the fabric material for sewing, the presser foot likewise is urged downwardly by the presser foot lift lever against the upper surface of the fabric material. At the same time, the actuator will be engaged by the control system of the sewing system so as to apply additional compression pressure or force to the presser foot as needed to further compress the fabric material to an amount sufficient to enable the loopers to catch and pull the threads from the sewing needles for completing a sewing operation. Thereafter, as the needles move upwardly along their return stroke, such movement is translated to the presser foot lift lever, which accordingly pivots the presser foot upwardly. At the same time, the actuator is deactivated to release the pressure therefrom, so as to reduce the compressive force being applied to the fabric material to an amount sufficient to enable the feed dogs, feed belt or other feeding mechanism of the sewing system to engage and incrementally advance the fabric material through the sewing area.

Alternatively, the action of the presser foot lift lever can be further extenuated or additional compressive force can be applied, such as by the use of compression springs, to maintain the presser foot in a lowered, compressive position. The actuator then can be used to pull or lift the presser foot against this biasing or compressive force as needed to allow incremental transfer or movement of the fabric material.

Various objects, features and advantages of the present invention will become apparent to those skilled in the art upon reading the following detailed description, taken in conjunction with the accompanying drawings.

DETAILED DESCRIPTION OF THE INVENTION

Figure 1:
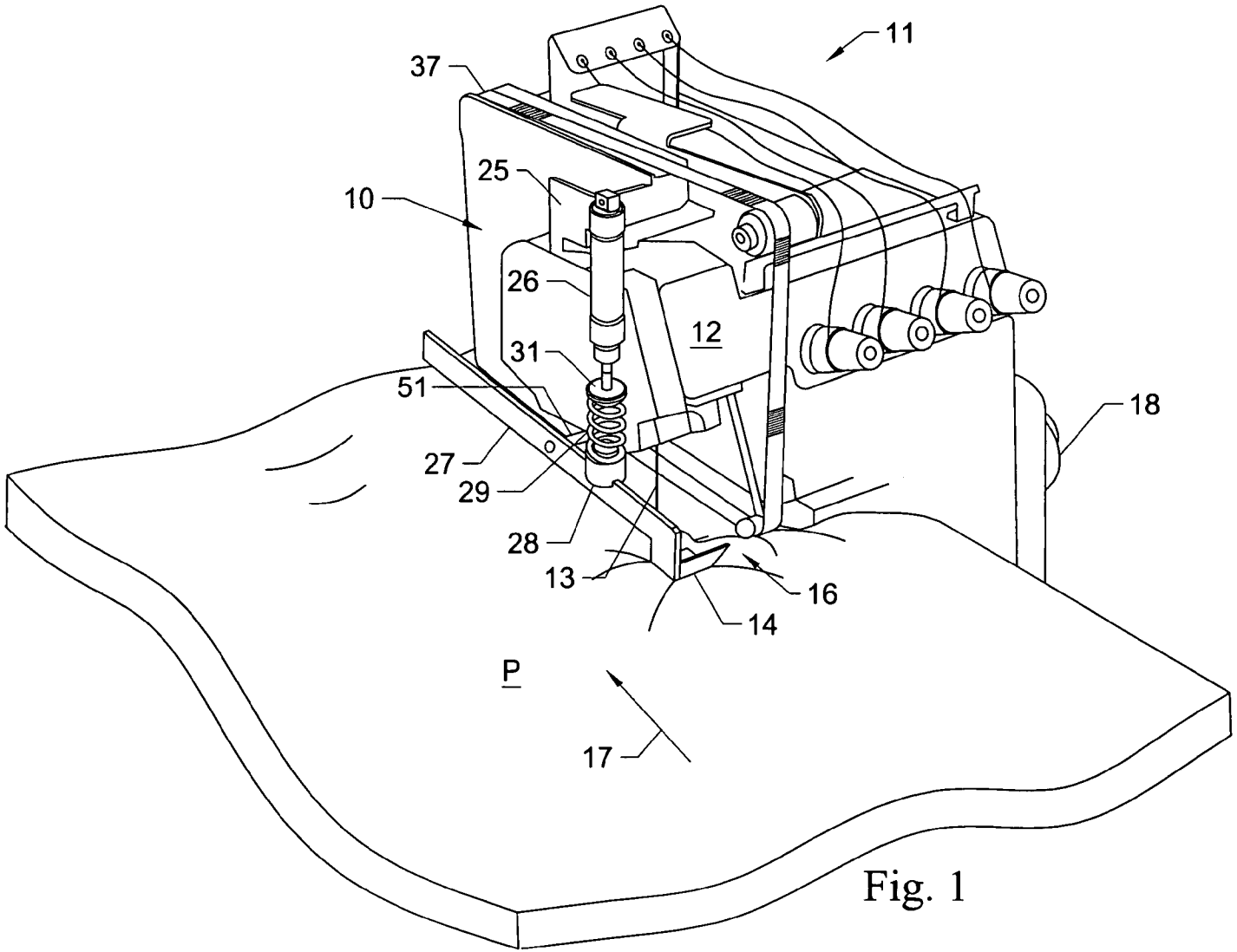
FIG. 1 is a perspective illustration of a sewing station incorporating the presser foot control system of the present invention.
Figure 2:
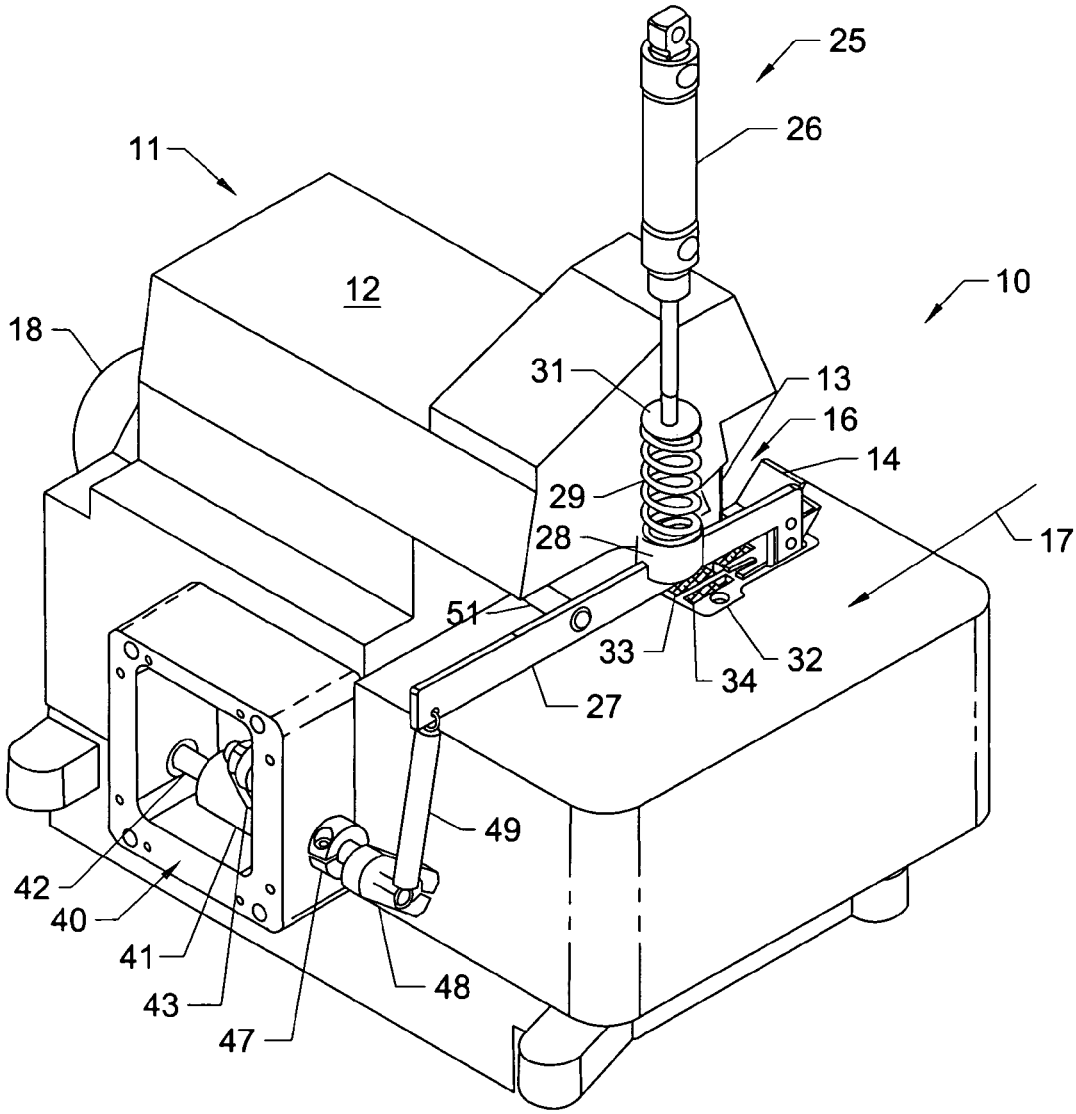
FIG. 2 is a rear perspective view of the sewing station and presser foot control system similar to FIG. 1.
Figure 3A:
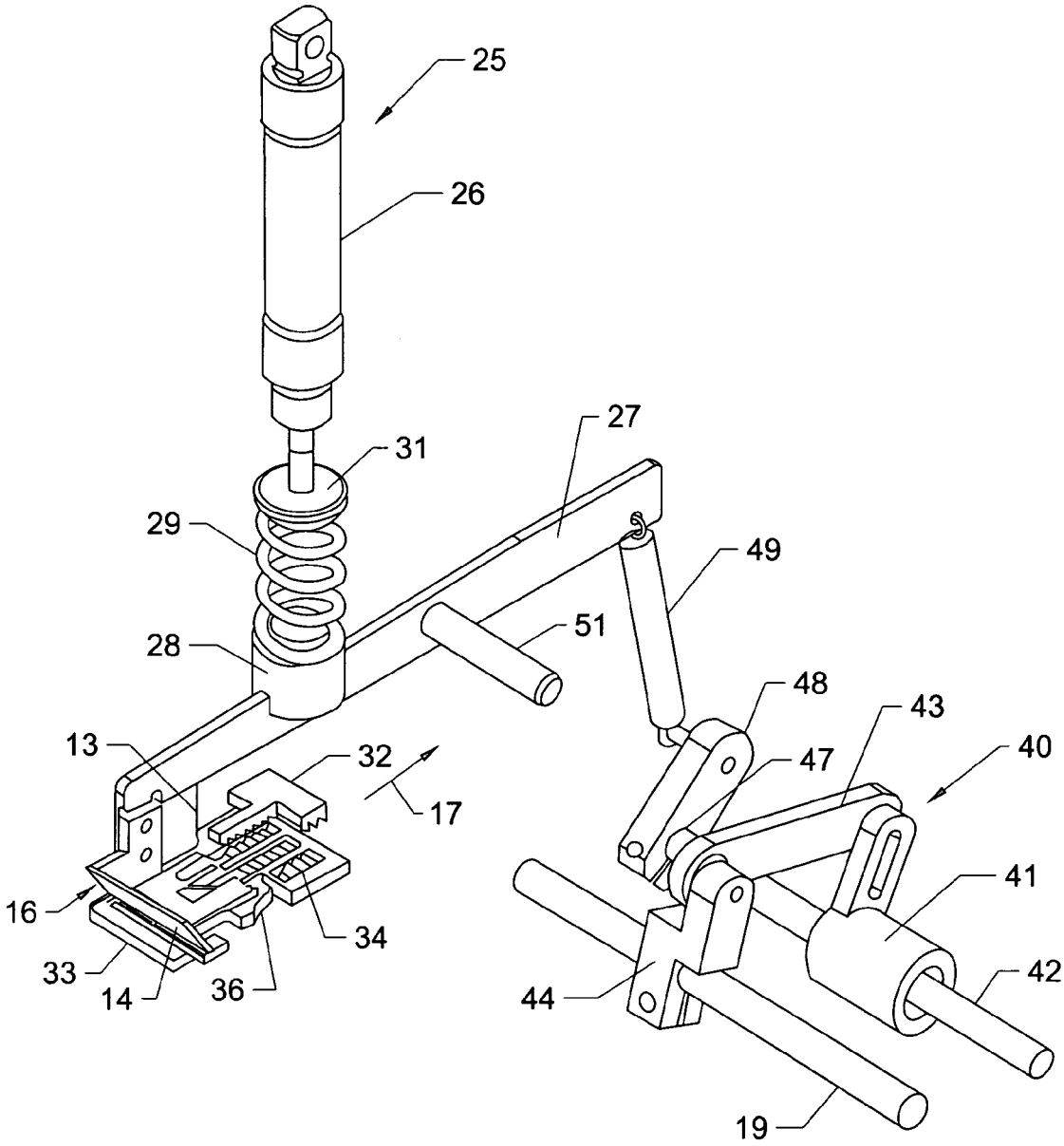
FIG. 3A is a schematic illustration of the presser foot control system of the present invention linked to the main drive shaft of a sewing station.
Figure 3B:
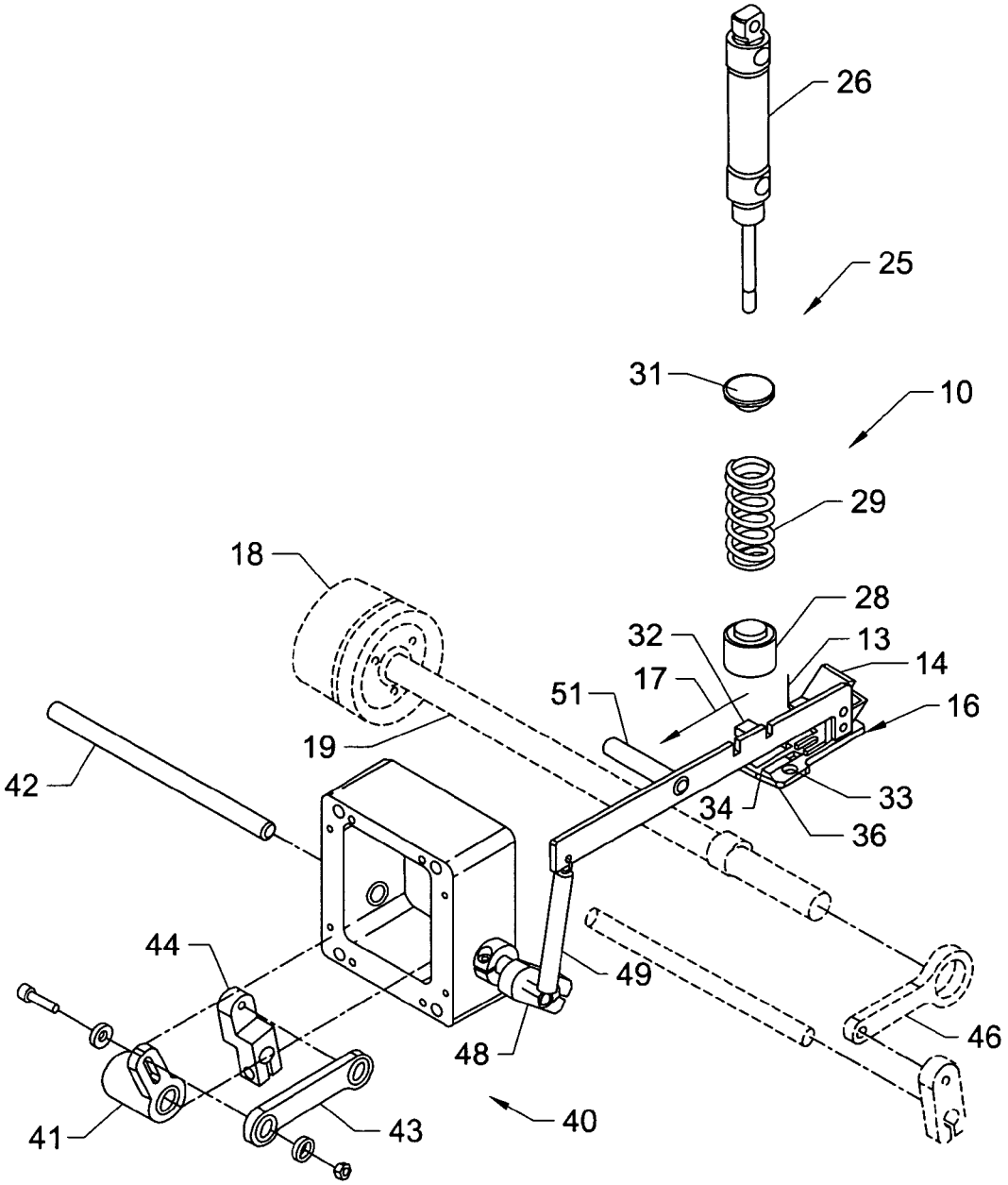
FIG. 3B is an exploded perspective view schematically illustrating the presser foot control system of the present invention.

Referring now to the drawings in greater detail, the presser foot control system 10 of the present invention is generally illustrated in FIGS. 1–3B. The presser foot control system 10 typically will be mounted to a sewing station 11, such as an Atlanta Attachment Model 1337 Flanging Station, or other similar sewing system adapted to sew thicker, foamed or heavier gauged fabric material. As shown in FIGS. 1 and 2, the sewing station 11 generally includes a sewing head 12 having one or more sewing needles 13 and a presser foot 14 that define a sewing area 16 through which a work piece such as a fabric material panel "P", such as a mattress pillow top, border or other thick heavy gauge material is passed in the direction of arrow 17 for a sewing or flanging operation. The sewing station 11 further will include a drive such as a motor 18 that drives a main shaft 19 (FIGS. 3A–3B) for reciprocating the needle(s) 13 during a sewing operation. As indicated in FIGS. 3A–3B, the presser foot control system 10 of the present invention generally is driven off of the main drive shaft 19 of the sewing station so as to communicate the reciprocal motion of the needle to the presser foot of the sewing station to the presser foot 14 as needed for sewing the fabric material panel P, while thereafter enabling transfer and movement of the fabric panel through the sewing area.

As shown in the FIGS. 2–3B, the presser foot control system 10 includes a pressure control assembly 25 generally comprising an actuator 26, here shown as a pneumatic or hydraulic cylinder, although various other types of actuators or drive units also can be used, such as tension or compression spring sets, reversible motors, mechanically timed drive mechanisms or other actuators. The actuator 26 will be engaged by the system control of the sewing station periodically in timed relation with the reciprocation of the needle(s) to apply an additional compression force to the presser foot 14 to fully compress the fabric material as needed for sewing. The actuator 26 is mounted adjacent the sewing area 16 (FIG. 2) of the sewing station 11 and will be attached to a presser foot lift lever 27 such as via a connector 28. Additionally, a compression spring 29 typically will be provided between the actuator 26 and the connector 28. The spring 29 generally applies a nominal compression force against the presser foot lift lever 27 for maintaining the presser foot in a normally lowered sewing attitude or position against the upper surface of the fabric material panel P as shown in FIG. 1.

Thereafter, as the fabric material is sewn, the control system of the sewing station will engage the actuator to periodically apply additional pressure as needed in timed relation with the reciprocation of the needles to compress the fabric material being sewn as needed to ensure engagement and pickup of the needle threads by the loopers (not shown) of the sewing station. A adjustable pressure plate 31 (FIGS. 2–3B) further generally is positioned between the actuator 26 and the spring 29 to enable adjustment of the nominal spring biasing force being applied by the spring to the pressure foot lift lever to accommodate different thicknesses and/or multiple ply fabric materials being sewn.

Still further, it will be understood that while a cylinder or other actuator can be used to apply additional pressure at timed intervals as needed to cause the presser foot to further compress the textile or fabric material panel being sewn, it is also possible to reverse the operation of the actuator for relieving pressure applied to the presser foot as needed. In such a system, a full compression force generally will be applied to the presser foot, such as by the compression spring 29 or through some other pressure applicator or mechanism. At timed intervals during the sewing operation, the actuator 26 can be engaged to counteract such a full compression pressure being applied to the presser foot to enable and/or cause the presser foot to be raised from its compressive engagement with the fabric material panel for the continued transfer/movement of the fabric material panel.

As further shown in FIGS. 3A–3B, the presser foot system generally will include a feed system or mechanism such as a top feed dog 32 mounted above a needle plate 33 of the sewing station, and a bottom feed dog 34 (FIG. 3A) positioned below the needle plate and in an opposed position with respect to the top feed dog 31 for engaging the bottom surface of the fabric material through slots or feed openings 36 in the needle plate 33 and presser foot 14. The top feed dog 32 typically will engage the fabric as the presser foot is raised, with the fabric material being clamped between the top and bottom feed dogs and thereafter pulled or advanced incrementally longitudinally forward through the sewing zone 16 by the movement of the feed dogs in the direction of arrow 17. Additionally, as an alternative to the use of the top and bottom feed dogs, or in conjunction therewith, a top feed belt 37 also could be used, as indicated in FIG. 1, for pulling the fabric material panel P through the sewing area 16.

Still further, the presser foot control system will be linked to the operation of the main drive shaft 19 of the sewing station by an eccentric drive system 40 as shown in FIGS. 3A–3B. The eccentric drive system generally includes a clutch drive 41 mounted to a foot drive shaft 42 and is driven off the main drive shaft 19 of the sewing station so as to impart a rocking motion to the foot drive shaft. The clutch drive 41 is connected via a linkage 43 to a rocker arm 44 that typically is mounted on or connected to the drive shaft either directly or through use of a connector arm 46 (FIG. 3B), so as to be driven by the main drive shaft 19. The foot drive shaft 42 is connected at one end 47 to the presser foot lift lever 27 by a connector 48 and linkage 49. The eccentric drive system accordingly communicates the reciprocating operation of the main drive shaft 19 of the sewing station to the presser foot lift lever for raising/lowering the presser foot 14 in timed relation with the reciprocation of the needle 13. Still further, a pivot pin 51 is attached to the presser foot lift lever at an intermediate point between the first or proximal end and the second or distal end thereof so as to enable the pivoting motion of the presser foot lift lever to cause the presser foot to be raised and lowered in timed relation with the reciprocal motion of the needle.

In operation, as the sewing station sews a thick, padded, or heavy gauge fabric material work piece or multi-ply panel as indicated in FIG. 1, with the downward stroke of the needle, the presser foot is moved downwardly into compressive engagement with the upper surface of the fabric. At the same time, the actuator generally also is engaged to apply additional compression pressure or force to the presser foot as needed to sufficiently compress the fabric material to enable the loopers of the sewing station to catch and pull the threads from the needle as needed to form the stitches in the fabric material. Thereafter, as the return stroke of the needle is initiated, the presser foot likewise is raised, while the actuator simultaneously is deactivated so as to release the additional pressure therefrom and enable the presser foot to be raised.

At about the same time, the top and bottom feed dogs will engage and begin pulling or advancing the fabric panel or work piece incrementally through the sewing station, independently of the operation and movement of the presser foot control system. Thereafter, as the feed dogs complete their incremental forward movement of the fabric panel, the presser foot again is lowered into engagement with the fabric panel and the actuator is reengaged to apply the additional needed pressure as the sewing cycle continues. As a result, the application of the additional pressure as needed for sewing thicker, padded or multiple work pieces can be more precisely controlled to enable faster production speeds for the sewing station during the sewing of the thicker, heavier gauge fabric materials or other work pieces.

It will be further understood by those skilled in the art that while the foregoing has been disclosed above with respect to preferred embodiments or features, various additions, changes, and modifications can be made to the foregoing invention without departing from the spirit and scope of thereof.

What is claimed is:

1. A method of sewing a thick fabric material, comprising:

moving the fabric material through a sewing station and penetrating the fabric material with a sewing needle;

as the sewing needle penetrates the fabric material, moving a presser foot against an upper surface of the fabric material in timed relation with the movement of the needle through the fabric material;

at about the same time, engaging an actuator to apply an additional compressive force to the presser foot as needed to sufficiently compress the fabric material for sewing;

deactivating the actuator as the sewing needle begins a return stroke to release the additional compressive force from the presser foot;

moving the presser foot away from the upper surface of the fabric material; and engaging and moving the fabric material forwardly through the sewing station.

2. The method of claim 1 and wherein moving the presser foot against the upper surface of the fabric material comprises driving an eccentric linked to a presser foot lift lever off a main drive of the sewing station.

3. The method of claim 1 and wherein engaging and moving the fabric material comprises moving a top feed dog into engagement with the upper surface of the fabric material and pulling the fabric material forwardly.

4. The method of claim 3 and wherein the fabric material is advanced incrementally through the sewing station.

5. The method of claim 1 and further comprising applying a nominal biasing force to maintain the presser foot in engagement with the upper surface of the fabric material.

6. The method of claim 1 and further comprising adjusting the additional compressive force applied to the presser foot.

7. The method of claim 1 and wherein the fabric material is compressed an amount sufficient to ensure that the sewing needle penetrates the fabric material to a point at which a thread carried by the needle will be engaged by a looper of the sewing station.

8. A method of sewing a work piece having an increased thickness, comprising:

inserting a sewing needle carrying a thread into the work piece;

moving a presser foot into compressive engagement against an upper surface of the work piece in timed relation with the movement of the needle into and through the work piece;

applying a compressive force with the presser foot so as to compress the work piece to a level sufficient to ensure penetration of the needle through the work piece to a depth at which the thread carried by the needle will be engaged by a looper;

releasing the compressive force and moving the presser foot away from the upper surface of the work piece in timed relation with a return stroke of the needle; and engaging and advancing the work piece forwardly to advance the sewing operation for the work piece.

9. The method of claim 8 and wherein engaging and moving the fabric material comprises moving a top feed dog into engagement with the upper surface of the fabric material and pulling the fabric material forwardly.

10. The method of claim 9 and wherein the fabric material is advanced incrementally through the sewing station.

11. The method of claim 8 and further comprising adjusting the additional compressive force applied to the presser foot.

12. The method of claim 8 and wherein applying a compressive force comprises engaging an actuator to apply additional pressure to the presser foot against the work piece as needed to compress the work piece.

13. The method of claim 8 and wherein applying a compressive force comprises exerting a biasing force against the presser foot so as to urge the presser foot downwardly against the work piece.

14. The method of claim 13 and wherein releasing the compressive force comprises engaging an actuator to urge the presser foot upwardly against the biasing force applied to the presser foot.

* * * * *